US005723424A

United States Patent [19]

Jennings

[11] Patent Number: 5,723,424

[45] Date of Patent: Mar. 3, 1998

[54] CONCRETE CLEANING MIXTURE

[76] Inventor: Paul E. Jennings, 4606 SW 7th Ave., Cape Coral, Fla. 33914

[21] Appl. No.: 718,026

[22] Filed: Sep. 23, 1996

[51] Int. Cl.[6] ..... C11D 1/00; B08B 7/00; B08B 3/14

[52] U.S. Cl. ..... 510/240; 134/6; 134/7; 134/42

[58] Field of Search ..... 510/240; 134/6, 134/7, 42

[56] References Cited

U.S. PATENT DOCUMENTS 4,459,368 7/1984 Jaffee et al. ..... 502/80
5,359,961 11/1994 Goss et al. ..... 119/173

*Primary Examiner*—Mukund J. Shah
*Assistant Examiner*—Tamthom T. Ngo

[57] ABSTRACT

The invention pertains to a cleaning mixture for use in cleaning concrete pads. The mixture consists of two components and each of the two components has two ingredients. The first ingredient of the first component consists of an OIL-DRI -type all purpose absorbent clay material while the second ingredient is a cat litter or an addapolgite-type clay. Both of the ingredients of the first component are of a granular material. The second component also has two ingredients, the first is a Kaolin-type clay and the second ingredient is a finely ground clay dust. The first component, when applied to the surface of a contaminated concrete, will loosen and break up the hardened oil or grease deposit while the ingredients of the second component, when applied to the concrete surface after the the residue of the first component has been removed will absorb the oil from the pores and crevices of the concrete and apply a whitening effect to the concrete and also will seal the pores and the crevices of the concrete.

7 Claims, No Drawings

CONCRETE CLEANING MIXTURE

BACKGROUND OF THE INVENTION

This invention pertains to cleaning concrete pads. "Concrete pad" is a generic term for wherever concrete is laid down in gas stations, parking garages, parking lots, repair shops, Bank drive-thrus, drive ways etc. All these pads are subject to vehicular traffic. As is well known, all vehicular engines, especially when they are hot, sooner or later will be depositing oil or grease because of deteriorated seals. These deposits end up on the concrete pads to thereby create very unsightly areas. The problem multiplies over a longer period of time when the deposits begin to harden, especially, if they are exposed to sunlight. Concrete is a porous substance and some of the oil will penetrate into the pores which makes its removal that much more difficult. Many of the above named pads are also subject to pedestrian traffic and the shoes they are wearing pick up the tar-like substance and carry the same to other areas such as carpets in banks or stores which contributes to their cleaning or repair bills to a considerable extent.

Many attempts have been made to clean the above noted pads which were more or less successful or more or less expensive. In one such attempt, merely sand has been spread over the affected area which only results in the sand picking up the oil on the surface but not cleaning the same because the old residue that was there before has not been removed. Other attempts to clean concrete pads involve the application of liquids that are based on petroleum products or mineral spirits. One such product is known under the name "GUNK". It is mainly an engine cleaner but works equally as well on concrete. When it is applied to concrete, it must be brushed vigorously and then cleaned up or removed with water. This kind of cleaning creates environmental problems because the water is now contaminated by petroleum or mineral spirits and it ends up in the environment such as storm sewers or natural water run-offs.

Moreover, this kind of treatment still does not result in clean pads because it is merely a surface treatment and it leaves the surface somewhat discolored which easily can be seen when comparing a cleaned area to an untreated area which did not need any cleaning. That is, areas that are adjacent to each other. Also, the above noted treatments create fumes which may be lingering for quite a while.

OBJECTS OF THE INVENTION

The object of the invention is to create a method and a product to clean concrete pads that do not impact on the environment. The materials used are very easy to apply and are very inexpensive. The application of the materials is in a dry state and remains that way throughout the procedure.

DETAILED DESCRIPTION OF THE INVENTION

The materials used in cleaning concrete will now be described first and thereafter the method of using the same.

The concrete cleaning mixture consists of two components and each of the components has two ingredients. The first component consists of granular materials. The first ingredient of the first component is known under the TM of "OIL DRI" and it is an all purpose absorbent clay material in a very light color. The second ingredient is a cat litter of the attapulgite-type clay because it is a superior type of clay and it breaks down much easier than the OIL-DRI material when applied at a location. It is actually a very white color or at best a light off-gray color and it has a whitening effect. Therefore, the OIL-DRI material stays available much longer for the grinding phase of the method of using. The first component of the concrete mixture is first applied to a contaminated concrete surface because the granular material ingredients start to break up the surface build up on top of the concrete which can be as much as ⅛th of an inch.

As mentioned above, the OIL-DRI granular material is much longer available in the breaking-up process, while the cat litter starts the whitening process. All the while, because of the nature of the clay material, the loosened oil and/or grease is being absorbed by the ingredients of the first component.

Experiments have been made in allotting various percentages to the ingredients. At this point it can be stated that a 50% by weight for each of the ingredients is preferred. A 60% by weight for the OIL-DRI and a 40% by weight for the cat litter have been tried and also a 40% to 60% by weight, respectively, has been tried with almost equal results. But each of the ingredients contributes a unique characteristic to the cleaning process.

Attention is now directed to the second component of the concrete cleaning mixture. As mentioned earlier, each of the components consists of two ingredients. The difference between this and the first component is that this component is in a powder form as opposed to a granular form. The first ingredient is a Kaolin which is basically a clay material. Its use is mostly known in the casting and setting of ceramics or in the firing of kilns. Another use is known as a bonding filler in the production of fiber glass The second ingredient of the second component is a finely ground clay dust. It is a free-flow material of a somewhat tan color. It is known in industrial applications around stationary machinery in machine shops where oil can leak from the machinery or is splattered from the working tools. It is therefore known as being able to absorb oil from around the machinery but only when the oil is in a fresh state but it is not known as a cleaning ingredient in combination with other ingredients. Again, it is important to consider the various ranges of the ingredients. Experiments have shown that the Kaolin applied to the concrete at 100% does not work very well because it is not very stable at 100% because it tends to ball up and thereby resists an even application. Therefore, the use of the second ingredient, that is, the finely ground clay dust tends to stabilize the application of the Kaolin in combination.

Also, Kaolin has a high whitening effect while the finely ground clay dust, being of a light tan color, assists in assimilating the color normally found in concrete pads. Kaolin can be present at 90% to 50% as an ingredient in the second component. Yet, a ratio of 50% to 50% is preferred. This is highly desirable when used by a home owner and applied to the driveway or the pad in the garage. It is foreseen that the concrete cleaning mixture be sold with the first component in a large container and the second component in a smaller container but contained within the first container. Of course, both components could be sold in their own containers but side by side.

METHOD OF USING THE CLEANING MIXTURE

In more severe cases, that is, where the old oil has built up and has hardened on top of the concrete surface, it is important that component one be applied first and thereafter is subjected to a rubbing or an abrading action. For this purpose a tool is being used such as a piece of hardened rubber or a section of an old tire attached to a rake-like hand tool. Surprisingly, the rubbing or abrading action does not have to be vigorous or of long duration. The two granular ingredients loosen the old oil on the surface of the concrete. The cat litter or the addapolgite-type clay breaks down easier than the OIL-DRI all purpose absorbent clay and begins to absorb the oil from the pores and crevices of the concrete while the OIL-DRI ingredient keeps on loosening and freeing the old oil form the surface of the concrete while both ingredients continue the whitening action. Thereafter, the residue of the first component is being removed either by sweeping or by vacuum. The second component of the cleaning mixture is now applied to the concrete and the clay of each of their ingredients the Kaolin and the finely ground clay dust penetrate deeper into the concrete pores and crevices and extract and absorb the oil therefrom and they continue in their whitening action.

No further rubbing or abrading action is necessary now but a mere spreading action. After a certain period of time, the remaining residue is now being removed either be sweeping or by vacuum. It has surprisingly been found that only the second component, as described above, needs to be applied on concrete pads having less surface contaminants that have not hardened over longer periods of time. Since the surface is already available, the benefits of the two ingredients go straight to work in the absorbing and the whitening process. Another benefit when using Kaolin is the side but highly desirable effect in that the clay material penetrates into the pores of the concrete pad, stays there and acts as a sealer. Thereby, new cleaning treatments are needed much less frequently.

It has also been found that the second component should not be applied to the concrete first before the first components. The Kaolin, when studied under a microscope shows the material to be slate-like in appearance and not like a powder. Therefore, the slate-like material fights the rubbing action of the first component by letting the granular material slide over itself so that it cannot reach the surface of the concrete.

It now can be seen that the invention is very effective but it is simple to apply. It is a complete dry process and will not contaminate the environment and the materials used are totally harmless with regard to humans or animals and are totally environment friendly.

What I claim is:

1. A concrete cleaning mixture consisting of one component, said one component having two ingredients, a first ingredient is an all purpose clay material and said second ingredient is an attapulgite-type clay, both of said ingredients being of a granular material.

2. The cleaning mixture of claim 1, wherein said two ingredients are present in said component by weight at a range of 30% to 70% or at a range of 70% to 30%, respectively.

3. The cleaning mixture of claim 1, wherein said two ingredients are present in the component by weight at a range of 50% to 50%.

4. A concrete cleaning mixture consisting of one component having two ingredients, a first ingredient of said ingredients is a Kaolin-type clay and said second ingredient is a finely ground clay dust, both of said ingredients being a powder material.

5. The cleaning mixture of claim 4, wherein said two ingredients of the second component are present in said second component by weight at a range of 90% to 10% or 10% to 90%, respectively.

6. The cleaning mixture of claim 4, wherein said two ingredients of said second component are present in said second component by weight at a range of 50% to 50%.

7. A method of cleaning concrete including the steps of using a cleaning mixture consisting of one component having two granular ingredients, the first ingredient is an all purpose absorbent clay material and the second ingredient is an attapulgite-type clay, spreading the granular ingredients onto a surface of concrete, rubbing the ingredients against said concrete surface and removing said ingredients from said surface, thereafter spreading a different cleaning mixture consisting of one component onto said concrete surface, said component also having two ingredients, a first ingredient is a Kaolin-type clay and the second ingredient is a finely ground clay dust, both of said ingredients are of a powder material, and then removing the ingredients from said concrete surface after a time interval.

* * * * *